US010950950B2

(12) United States Patent
Fukunaga et al.

(10) Patent No.: US 10,950,950 B2
(45) **Date of Patent: *Mar. 16, 2021**

(54) ANTENNA

(71) Applicant: TDK CORPORATION, Tokyo (JP)

(72) Inventors: Tatsuya Fukunaga, Tokyo (JP); Yuichi Kimura, Saitama (JP)

(73) Assignee: TDK CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/550,799

(22) Filed: Aug. 26, 2019

(65) Prior Publication Data

US 2020/0076087 A1 Mar. 5, 2020

(30) Foreign Application Priority Data

Aug. 30, 2018 (JP) ..... 2018-161918

(51) Int. Cl.
*H01Q 13/10* (2006.01)
*H01Q 21/30* (2006.01)

(52) U.S. Cl.
CPC ..... *H01Q 13/106* (2013.01); *H01Q 21/30* (2013.01)

(58) Field of Classification Search
CPC ..... H01Q 13/10; H01Q 13/106; H01Q 21/30; H01Q 9/0414; H01Q 9/0464; H01Q 5/392
See application file for complete search history.

(56) References Cited

U.S. PATENT DOCUMENTS

| | | | | |
|---|---|---|---|---|
| 9,673,526 | B1 * | 6/2017 | Jensen | H01Q 9/0414 |
| 10,020,560 | B1 * | 7/2018 | Chou | H01Q 1/1214 |
| 2006/0001574 | A1 * | 1/2006 | Petros | H01Q 9/0407 343/702 |
| 2007/0052587 | A1 * | 3/2007 | Cheng | H01Q 9/0457 343/700 MS |
| 2007/0268188 | A1 * | 11/2007 | Guha | H01Q 9/0414 343/700 MS |
| 2012/0268347 | A1 * | 10/2012 | Tatarnikov | H01Q 9/0407 343/893 |

FOREIGN PATENT DOCUMENTS

| | | | |
|---|---|---|---|
| JP | 2008-172697 | A | 7/2008 |
| WO | 2007/060782 | A1 | 5/2007 |

* cited by examiner

*Primary Examiner* — Thai Pham
(74) *Attorney, Agent, or Firm* — Oliff PLC

(57) ABSTRACT

An antenna includes a dielectric, first and second antenna electrodes each having an annular shape, and a probe electrode. The dielectric has first to third planes parallel to each other in a stacking direction. The first and second antenna electrodes are respectively disposed on the first and second planes. The second antenna electrode is different in size from the first antenna electrode and disposed inward from the outer periphery of the first antenna electrode. The probe electrode is disposed on the third plane and overlaps the first and second antenna electrodes in plan view along the stacking direction. The first and second antenna electrodes are electrically powered via the probe electrode. The probe electrode is remote from the first antenna electrode by a first distance and remote from the second antenna electrode by a second distance different from the first distance along the stacking direction.

10 Claims, 12 Drawing Sheets

ANTENNA

CROSS REFERENCE TO RELATED APPLICATIONS

This application claims the benefit of Japanese Priority Patent Application No. 2018-161918 filed on Aug. 30, 2018, the entire contents of which are incorporated herein by reference.

BACKGROUND

The disclosure relates to an antenna supporting multiband operations. With the advancement of technology, there is a growing demand for broadband antennas that enable higher-speed communication, and multiband antennas that simultaneously use multiple frequency bands having different specifications. For example, International Publication No. 2007/060782 and Japanese Unexamined Patent Application Publication No. 2008-172697 disclose a multiband antenna including multiple antenna electrodes disposed on the same plane.

SUMMARY

An antenna according to one embodiment of the disclosure includes a dielectric, a first antenna electrode, a second antenna electrode, and a probe electrode. The dielectric has a first plane, a second plane, and a third plane that are different from each other and stacked parallel to each other in a stacking direction. The first antenna electrode has an annular shape and is disposed on the first plane. The second antenna electrode has an annular shape and is disposed on the second plane. The second antenna electrode is different in size from the first antenna electrode and disposed inward from an outer periphery of the first antenna electrode when seen in plan view along the stacking direction. The probe electrode is disposed on the third plane and overlaps the first antenna electrode and the second antenna electrode when seen in the plan view along the stacking direction. The first antenna electrode and the second antenna electrode are configured to be electrically powered via the probe electrode. The probe electrode is remote from the first antenna electrode by a first distance, and remote from the second antenna electrode by a second distance along the stacking direction. The second distance is different from the first distance.

BRIEF DESCRIPTION OF THE DRAWINGS

The accompanying drawings are included to provide a further understanding of the disclosure and are incorporated in and constitute a part of this specification. The drawings illustrate example embodiments and, together with the specification, serve to explain the principles of the disclosure.

DETAILED DESCRIPTION

Figure 1:
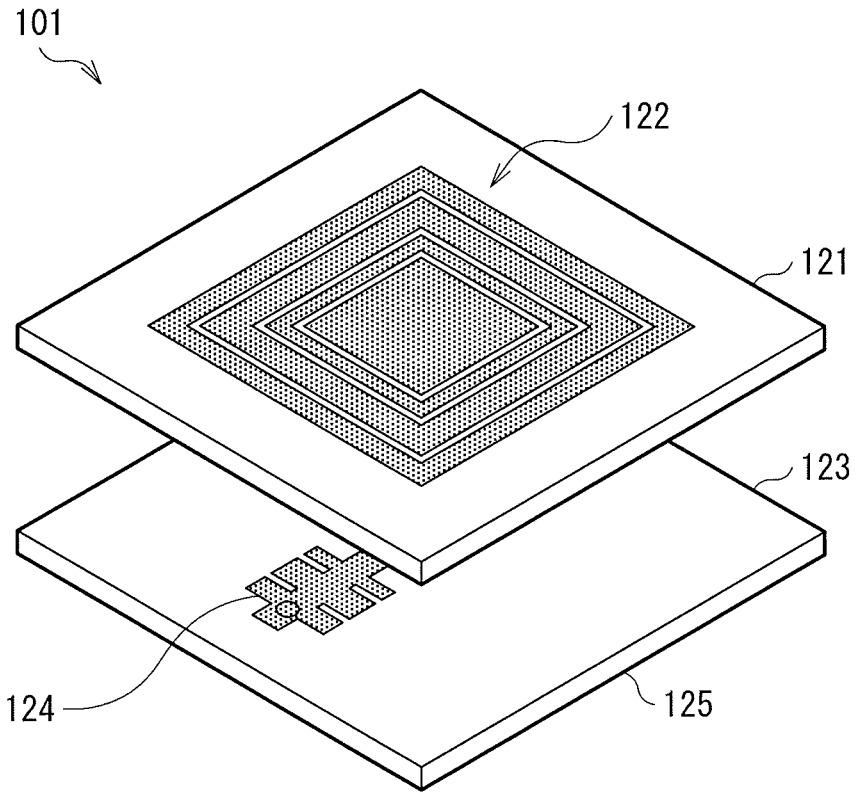
FIG. 1 is a perspective view of an antenna according to a comparative example.

In the following, some example embodiments of the disclosure are described in detail, in the following order, with reference to the accompanying drawings. Note that the following description is directed to illustrative examples of the disclosure and not to be construed as limiting the disclosure. Factors including, without limitation, numerical values, shapes, materials, components, positions of the components, and how the components are coupled to each other are illustrative only and not to be construed as limiting the disclosure. Further, elements in the following example embodiments which are not recited in a most-generic independent claim of the disclosure are optional and may be provided on an as-needed basis. The drawings are schematic and are not intended to be drawn to scale. Note that the like elements are denoted with the same reference numerals, and any redundant description thereof will not be described in detail. Note that the description is given in the following order.

0. Outline of Comparative Antenna and Inventive Antenna (FIGS. 1 to 3)
1. First Embodiment (Example Configuration of Antenna Including Two Antenna Electrodes: FIGS. 4 to 8)
   - 1.1 Example Configuration of Antenna of First Embodiment
   - 1.2 Modification Examples of First Embodiment
2. Second Embodiment (Example Configuration of Antenna Having Three Antenna Electrodes: FIG. 9 to FIGS. 16A and 16B)

2.1 Example Configuration of Antenna of Second Embodiment
2.2 Modification Examples of Second Embodiment
3. Other Embodiments

0. OUTLINE OF COMPARATIVE ANTENNA AND INVENTIVE ANTENNA

It is difficult with a typical antenna that includes multiple antenna electrodes on the same plane to widen respective fractional bandwidths of the antenna electrodes.

It is desirable to provide an antenna with multiple frequency bands each having a wide fractional bandwidth.

Figure 2:
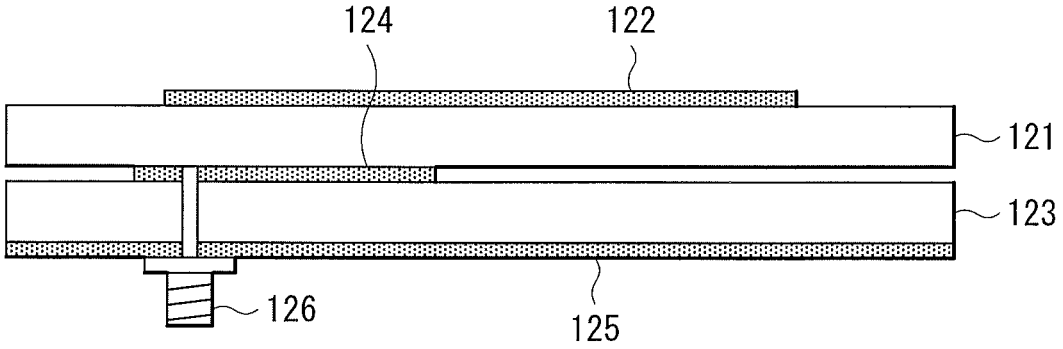
FIG. 2 is a cross-sectional view of the antenna according to the comparative example.

FIG. 1 illustrates an example perspective configuration of an antenna 101 according to a comparative example. FIG. 2 illustrates an example cross-sectional configuration of the antenna 101 according to the comparative example.

The antenna 101 according to the comparative example includes a first insulating substrate 121 and a second insulating substrate 123.

The first insulating substrate 121 is provided with an antenna device 122 that includes multiple antenna electrodes disposed on the same plane. The antenna electrodes of the antenna device 122 include annular antenna electrodes and a quadrangular antenna electrode.

The second insulating substrate 123 is provided with a probe electrode 124 and a ground layer 125. The second insulating substrate 123 is also provided with a power-feed connector 126. A portion of the power-feed connector 126 extends through the second insulating substrate 123 and is coupled to the probe electrode 124. The antenna device 122 is electrically powered via the power-feed connector 126 and the probe electrode 124.

Figure 3:
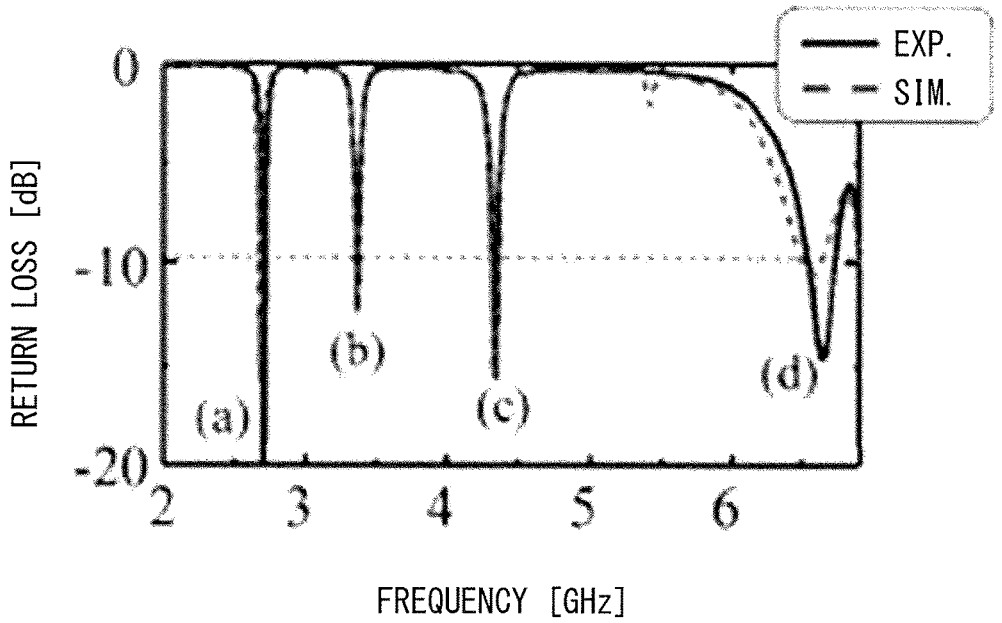
FIG. 3 is a diagram illustrating return loss characteristics of the antenna according to the comparative example.

FIG. 3 illustrates return loss characteristics of the antenna 101 according to the comparative example. In FIG. 3, a horizontal axis represents a frequency, and a vertical axis represents a return loss. A solid line in FIG. 3 represents a measured value (Exp.), and a dot line represents a simulation value (Sim.).

When the antenna 101 according to the comparative example is electrically powered via the probe electrode 124, an electric current flows in each of the antenna electrodes disposed on the same plane to cause each of the antenna electrodes to occur specific resonance based on the current path. First to fourth resonance modes are generated in the antenna 101. The first resonance mode is based on the longest one of the current paths of the antenna electrodes, the second resonance mode is based on the second longest one of the current paths of the antenna electrodes, the third resonance mode is based on the third longest one of the current paths of the antenna electrodes, and the fourth resonance mode is based on the shortest one of the current paths of the antenna electrodes. In FIG. 3, the characteristic in the first resonance mode is represented by (a), the characteristic in the second resonance mode is represented by (b), the characteristic in the third resonance mode is represented by (c), and the characteristic in the fourth resonance mode is represented by (d).

In the antenna 101 according to the comparative example, a multiband operation is achieved by the antenna electrodes disposed on the same plane. Each of the antenna electrodes in the antenna 101, however, generates its own frequency band. Therefore, as illustrated in FIG. 3, a fractional bandwidth is narrow in each of the resonance modes. The term "fractional bandwidth" used herein refers to a ratio of a bandwidth BW with a reflectance of 10 dB or less to a center frequency f0 (i.e., BW/f0).

In contrast, in an antenna according to any embodiment of the disclosure described below, at least first and second antenna electrodes are respectively disposed on a first plane and a second plane that are stacked in a stacking direction to form two frequency bands. In the antenna according to any embodiment of the disclosure described below, a probe electrode is remote from the first antenna electrode by a first distance, and remote from the second antenna electrode by a second distance along the stacking direction. The first distance is different from the second distance. This configuration widens a fractional bandwidth in each of the frequency bands. For example, it is possible to widen the fractional bandwidth of either the first antenna electrode or the second antenna electrode whichever is farther from the probe electrode. The antenna as a whole makes it possible to exhibit appropriate antenna characteristics.

1. FIRST EMBODIMENT (EXAMPLE CONFIGURATION OF ANTENNA INCLUDING TWO ANTENNA ELECTRODES

1.1 Example Configuration of Antenna of First Embodiment

Figure 4:
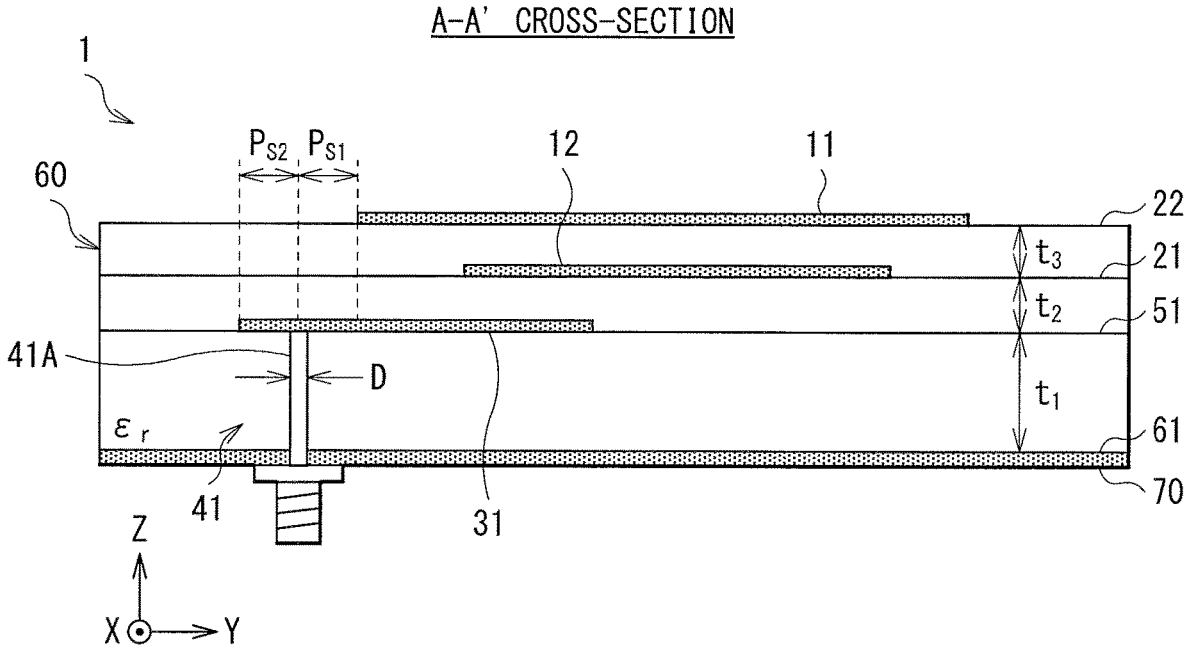
FIG. 4 is a cross-sectional view of an antenna according to one embodiment.
Figure 5A:
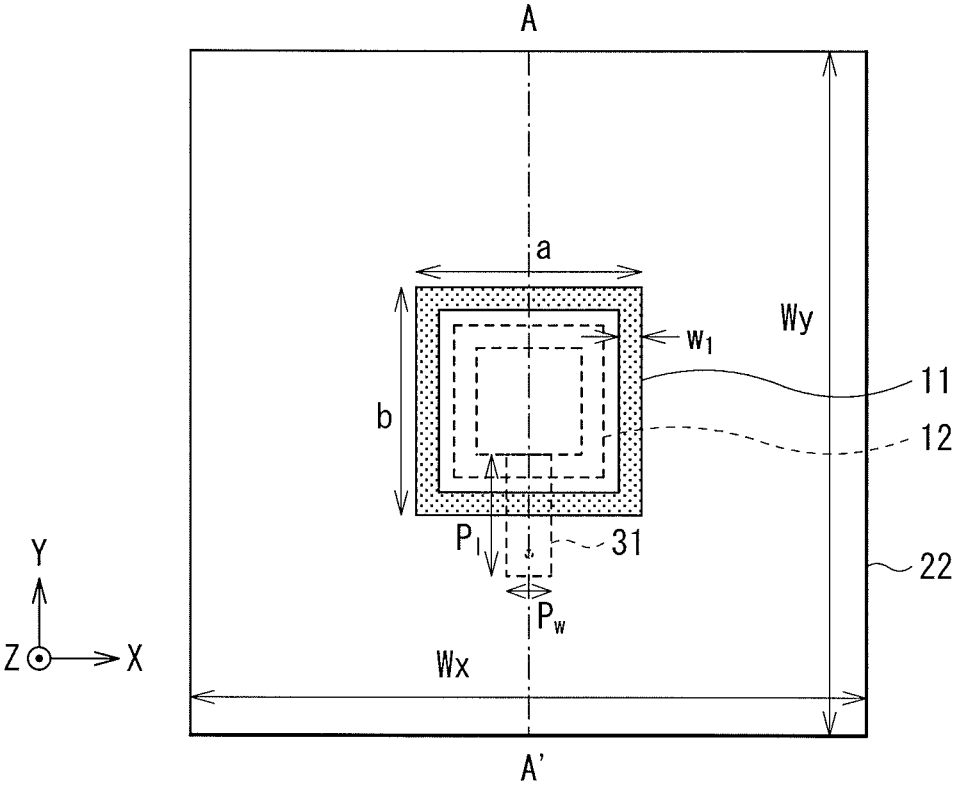
FIG. 5A is a plan view of an antenna layer of the antenna according to one embodiment.
Figure 5B:
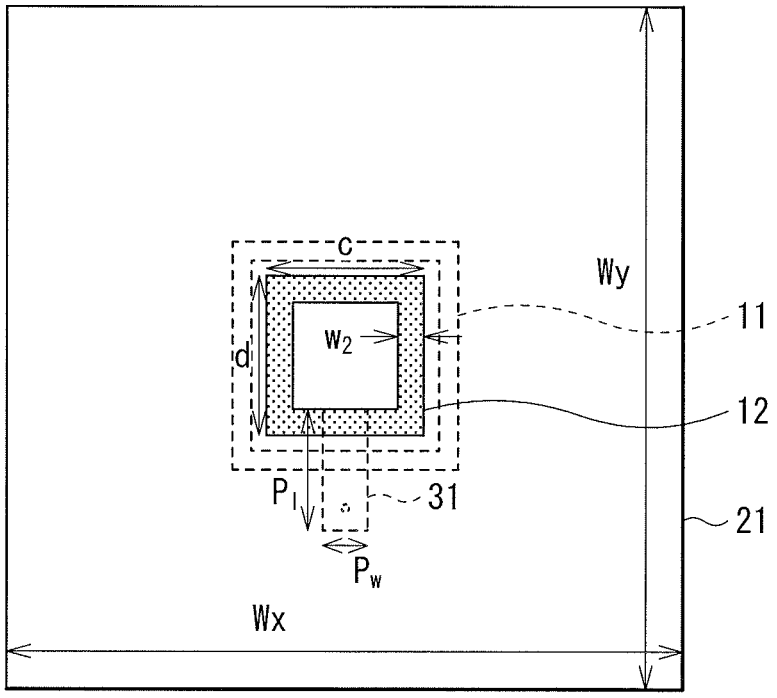
FIG. 5B is a plan view of another antenna layer of the antenna according to one embodiment.

FIG. 4 illustrates an example cross-sectional configuration of an antenna 1 according to a first embodiment of the disclosure. FIG. 5A illustrates an example planar configuration of a second antenna layer 22 of the antenna 1. FIG. 5B illustrates an example planar configuration of a first antenna layer 21 of the antenna 1. FIG. 4 is a cross-sectional view of the antenna 1 taken along the line A-A' of FIG. 5A.

The antenna 1 includes a dielectric 60. The dielectric 60 may have a plate shape and a laminated structure. The antenna 1 may include a ground layer 70, a probe layer 51, a first antenna layer 21, and a second antenna layer 22 that are laminated in this order from the bottom surface 61 of the dielectric 60.

The antenna 1 includes a first antenna electrode 11 and a second antenna electrode 12 each having an annular conductor pattern. The antenna 1 further includes a probe electrode 31 and a power-feed connector 41. The probe electrode 31 may have a linear conductor pattern.

With reference to FIG. 4 and FIGS. 5A and 5B, a Z-axis may extend along a stacking direction of the dielectric 60, and an X-axis and a Y-axis may be perpendicular to the Z-axis and orthogonal to each other. The X-Y plane may be parallel to first to third planes described herein. The same may be applied to modification examples and other embodiments of the disclosure described below.

The second antenna layer 22 of the antenna 1 may correspond to a specific but non-limiting example of the first plane according to one embodiment of the disclosure. The first antenna layer 21 of the antenna 1 may correspond to a specific but non-limiting example of the second plane according to one embodiment of the disclosure. The probe layer 51 may correspond to a specific but non-limiting example of the third plane according to one embodiment of the disclosure. When the second plane is disposed below the first plane, the first plane is the uppermost plane among the first to third planes of the antenna 1.

The first antenna electrode 11 having an annular shape is disposed on the second antenna layer 22.

The second antenna electrode 12 having an annular shape is disposed on the first antenna layer 21. The second antenna electrode 12 is different in size from the first antenna electrode 11. The second antenna electrode 12 is smaller in size than the first antenna electrode 11 and disposed inward from the outer periphery of the first antenna electrode 11 when seen in plan view along the stacking direction.

The first antenna electrode 11 and the second antenna electrode 12 may be mirror symmetric about a first symmetry plane perpendicular to the X-Y plane. Additionally, the first antenna electrode 11 and the second antenna electrode 12 may be mirror symmetric about a second symmetry plane perpendicular to the X-Y plane. The first symmetry plane and the second symmetry plane may be orthogonal to each other, for example. The first symmetry plane may extend through, for example, central portions of the first antenna electrode 11 and the second antenna electrode 12 when seen in plan view along the stacking direction, and may be parallel to the X-Z plane. The second symmetry plane may extend through, for example, central portions of the first antenna electrode 11 and the second antenna electrode 12 when seen in plan view along the stacking direction, and may be parallel to the Y-Z plane. Additionally, the first antenna electrode 11 and the second antenna electrode 12 may have rotational symmetry of 180 degrees about a rotation axis perpendicular to the X-Y plane. The rotation axis may extend through, for example, the central portions of the first antenna electrode 11 and the second antenna electrode 12 when seen in plan view along the stacking direction, and may be parallel to the Z-axis.

The power-feed connector 41 may have a through-conductor 41A. The through-conductor 41A may extend through the ground layer 70 and the bottom surface 61 to the probe electrode 31 of the dielectric 60. The first antenna electrode 11 and the second antenna electrode 12 may be electrically powered via the power-feed connector 41 and the probe electrode 31.

The probe electrode 31 is disposed on the probe layer 51. The probe electrode 31 overlaps the first antenna electrode 11 and the second antenna electrode 12 when seen in plan view along the stacking direction. This configuration allows the first antenna electrode 11 and the second antenna electrode 12 to be electrically powered via the probe electrode 31. The probe electrode 31 of the antenna 1 may be disposed directly adjacent to the first antenna layer 21 in the stacking direction.

When the first antenna electrode 11 and the second antenna electrode 12 are electrically powered via the probe electrode 31 in the antenna 1, an electric current may flow in each of the antenna electrodes to cause each of the antenna electrodes to occur specific resonance based on the current path. The first antenna electrode 11 may serve as an antenna operating in a frequency band including a specific resonance frequency f1. The second antenna electrode 12 may serve as an antenna operating in a frequency band including a specific resonance frequency f2.

In the antenna 1, the second antenna electrode 12 may have a round-trip length shorter than that of the first antenna electrode 11, and the specific resonance frequency f2 of the second antenna electrode 12 may be higher than the specific resonance frequency f1 of the first antenna electrode 11 (f2>f1). This allows the antenna 1 to operate in two modes having different frequency bands. Hereinafter, an operation mode including the specific resonance frequency f1, which is relatively low, may be referred to as a first mode, and an operation mode including the specific resonance frequency f2, which is relatively high may be referred to as a second mode.

Example dimensions and other parameters of respective portions of the antenna 1 illustrated in FIG. 4 and FIGS. 5A and 5B are as follows:

$$Wx=8.0,\ Wy=8.0,\ a=b=2.4\pm0.2,\ c=d=1.25\pm0.15,$$
$$w_1=0.26\pm0.06,\ w_2=0.26\pm0.06,\ P_w=0.50,$$
$$P_{s1}=0.55,\ P_{s2}=0.55,\ P_1=1.70,\ D=0.20,$$
$$t_1=0.5\pm0.3,\ t_2=0.5\pm0.3,\ t_3=0.5\pm0.3,\ \varepsilon r=3.4\pm0.5$$

where "εr" denotes a relative dielectric constant of the dielectric 60, and the reference characters other than "εr" denote respective dimensions in unit of millimeter [mm].

In the antenna 1, the probe electrode 31 is remote from the first antenna electrode 11 by a first distance, and remote from the second antenna electrode 12 by a second distance along the stacking direction. The second distance is different from the first distance. In the antenna 1 illustrated in FIG. 4, the probe electrode 31, the second antenna electrode 12, and the first antenna electrode 11 may be disposed in this order from below. Therefore, the first distance may be longer than the second distance. In other words, the first antenna electrode 11 may be farther from the probe electrode 31 than the second antenna electrode 12 is. This configuration makes it possible to widen the fractional bandwidth of a frequency band of the first antenna electrode 11 (i.e., a lower frequency band), for example. The antenna 1 thus makes it possible to exhibit appropriate antenna characteristics while widening each frequency band, compared with the antenna having the first antenna electrode 11 and the second antenna electrode 12 on the same plane.

Figure 6:
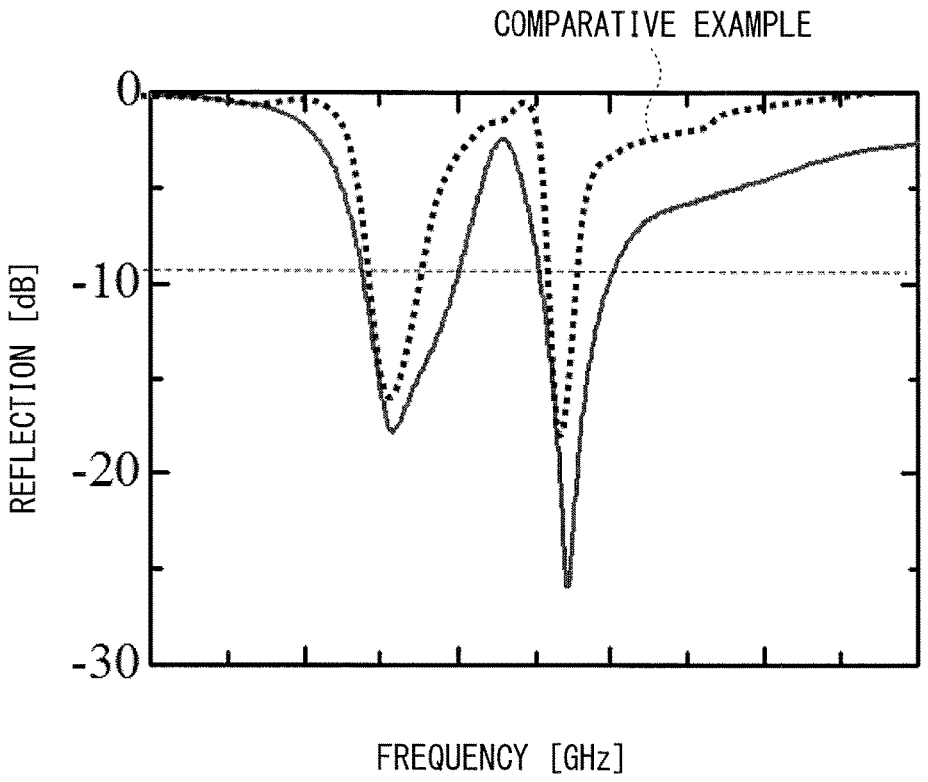
FIG. 6 is a diagram illustrating the reflectance of the antenna according to one embodiment and the reflectance of the antenna according to the comparative example.

FIG. 6 schematically illustrates the reflectance of the antenna 1 and the reflectance of the comparative example. The reflectance of the antenna 1 is indicated by a solid line, and the reflectance of the antenna of the comparative example is indicated by a dot line. A horizontal axis represents a frequency, and a vertical axis represents a reflectance [dB]. The antenna of the comparative example has the first antenna electrode 11 and the second antenna electrode 12 on the same plane.

As apparent from FIG. 6, the antenna 1 makes it possible to achieve frequency bands broader than those of the antenna of the comparative example both in a lower-frequency operation mode or a first mode and a higher-frequency operation mode or a second mode.

1.2 Modification Examples of First Embodiment

First Modification Example

Figure 7:
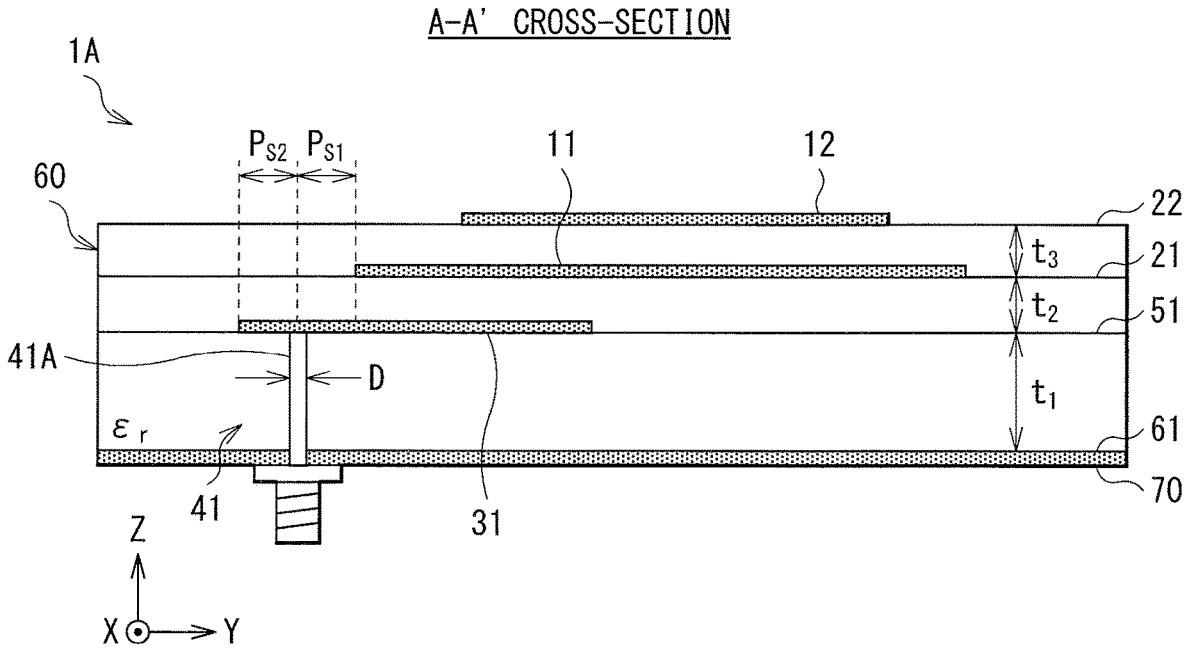
FIG. 7 is a cross-sectional view of an antenna according to one modification example of one embodiment.

FIG. 7 illustrates an example cross-sectional configuration of an antenna 1A according to a first modification example of the first embodiment. The cross-section illustrated in FIG. 7 may be substantially similar to the cross-section taken along the line A-A' of FIG. 5A.

The antenna 1A according to the first modification example may be different from the antenna 1 illustrated in FIG. 4 and FIGS. 5A and 5B in positions of the first antenna electrode 11 and the second antenna electrode 12. Except for the difference in the positions, the first antenna electrode 11 and the second antenna electrode 12 of the antenna 1A may be similar in planar shape to the first antenna electrode 11 and the second antenna electrode 12 of the antenna 1 illustrated in FIGS. 5A and 5B.

The first antenna layer 21 of the antenna 1A may correspond to a specific but non-limiting example of the first plane according to one embodiment of the disclosure. The second antenna layer 22 of the antenna 1A may correspond to a specific but non-limiting example of the second plane according to one embodiment of the disclosure. The probe layer 51 of the antenna 1A may correspond to a specific but non-limiting example of the third plane according to one embodiment of the disclosure. When the first plane is disposed below the second plane of the antenna 1A, the second plane is the uppermost plane among the first to third planes.

The first antenna electrode 11 having an annular shape is disposed on the first antenna layer 21 of the antenna 1A.

The second antenna electrode 12 having an annular shape is disposed on the second antenna layer 22 of the antenna 1A. The second antenna electrode 12 is different in size from the first antenna electrode 11. The second antenna electrode 12 may be smaller in size than the first antenna electrode 11 and disposed inward from the outer periphery of the first antenna electrode 11 when seen in plan view along the stacking direction.

In the antenna 1A, the probe electrode 31 is remote from the first antenna electrode 11 by a first distance, and remote from the second antenna electrode 12 by a second distance along the stacking direction. The second distance is different from the first distance. In the antenna 1A illustrated in FIG. 7, the probe electrode 31, the first antenna electrode 11, and the second antenna electrode 12 may be disposed in this order from below. Therefore, the first distance may be shorter than the second distance. In other words, the second antenna electrode 12 may be farther from the probe electrode 31 than the second antenna electrode 11 is. This configuration makes it possible to widen the fractional bandwidth of a frequency band of the second antenna electrode 12 (i.e., a higher frequency band), for example. The antenna 1A thus makes it possible to exhibit appropriate antenna characteristics while widening each frequency band, compared with the antenna having the first antenna electrode 11 and the second antenna electrode 12 on the same plane.

Other configurations and operations of the antenna 1A may be substantially similar to those of the antenna 1 according to the first embodiment.

Second Modification Example

Figure 8:
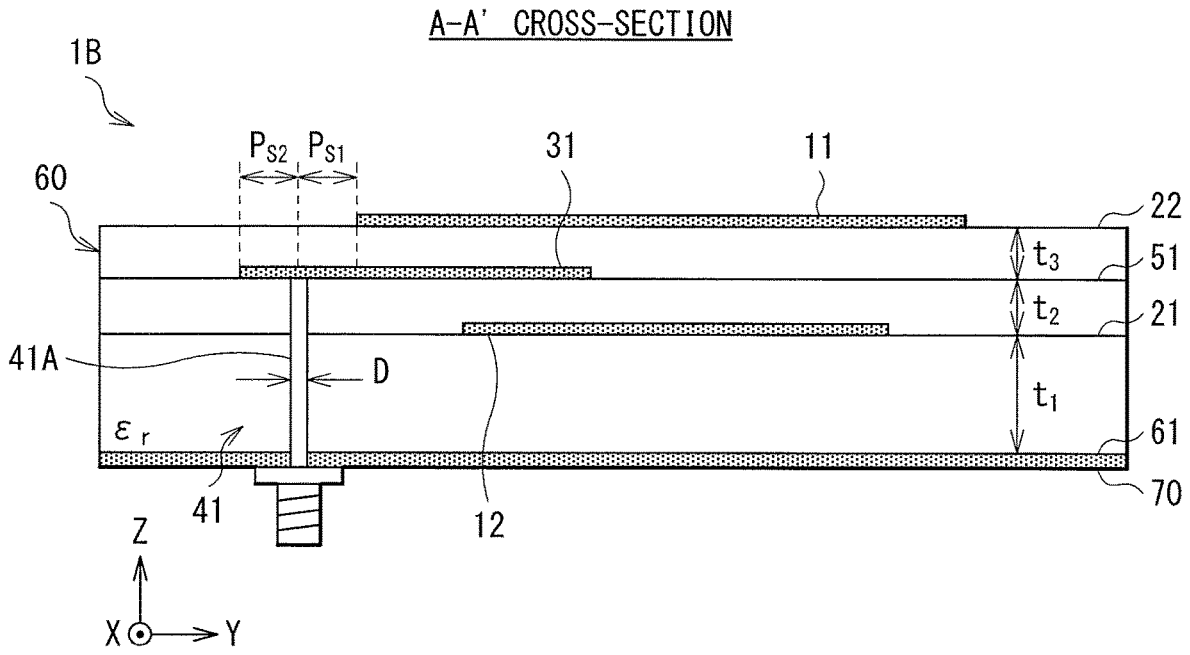
FIG. 8 is a cross-sectional view of an antenna according to one modification example of one embodiment.

FIG. 8 illustrates an example cross-sectional configuration of an antenna 1B according to a second modification example of the first embodiment. The cross-section illustrated in FIG. 8 may be substantially similar to the cross-section taken along the line A-A' of FIG. 5A.

The antenna 1B according to the second modification example may be different from the antenna 1 illustrated in FIG. 4 and FIGS. 5A and 5B in positions of the probe layer 51 and the probe electrode 31. Except for the difference in the positions, the probe electrode 31 may be similar in planar shape to the probe electrode 31 of the antenna 1 illustrated in FIGS. 5A and 5B.

In the antenna 1B, the ground layer 70, the first antenna layer 21, the probe layer 51, and the second antenna layer 22 may be disposed in this order from the bottom surface 61 of the dielectric 60. In other words, the probe layer 51 may be disposed between the first antenna layer 21 and the second antenna layer 22 of the antenna 1B.

The second antenna layer 22 of the antenna 1B may correspond to a specific but non-limiting example of the first plane according to one embodiment of the disclosure. The first antenna layer 21 of the antenna 1B may correspond to a specific but non-limiting example of the second plane according to one embodiment of the disclosure. The probe layer 51 of the antenna 1B may correspond to a specific but non-limiting example of the third plane according to one embodiment of the disclosure. When the second plane is disposed below the first plane in the antenna 1B, the first plane is the uppermost plane among the first to third planes. Additionally, the third plane may be disposed between the first plane and the second plane in the stacking direction.

The power-feed connector 41 of the antenna 1B may have a through-conductor 41A. The through-conductor 41A may extend through the ground layer 70 and the bottom surface 61 to the probe electrode 31 of the dielectric 60. The first antenna electrode 11 and the second antenna electrode 12 may be electrically powered via the power-feed connector 41 and the probe electrode 31.

The probe electrode 31 may be disposed on the probe layer 51. The probe electrode 31 overlaps the first antenna electrode 11 and the second antenna electrode 12 when seen in plan view along the stacking direction. This configuration allows the first antenna electrode 11 and the second antenna electrode 12 to be electrically powered via the probe electrode 31. The probe electrode 31 of the antenna 1B may be disposed directly adjacent to the first antenna layer 21 and the second antenna layer 22 in the stacking direction.

In the antenna 1B, the probe electrode 31 is remote from the first antenna electrode 11 by a first distance, and remote from the second antenna electrode 12 by a second distance along the stacking direction. The second distance is different from the first distance. In the antenna 1B, the probe electrode 31 may be disposed between the second antenna electrode 12 and the first antenna electrode 11. Therefore, two configurations may be envisaged for the antenna 1B: the first distance may be longer than the second distance in one configuration, while the first distance may be shorter than the second distance in the other configuration. In other words, two configurations may be envisaged for the antenna 1B: the first antenna electrode 11 may be farther from the probe electrode 31 than the second antenna electrode 12 is in one configuration, while the second antenna electrode 12 may be farther from the probe electrode 31 than the first antenna electrode 11 is in the other configuration. The configuration in which the first distance is longer than the second distance makes it possible to widen the fractional bandwidth of a frequency band of the first antenna electrode 11 (i.e., a lower frequency band), for example. The configuration in which the second distance is longer than the first distance makes it possible to widen the fractional bandwidth of a frequency band of the second antenna electrode 12 (i.e., a higher frequency band), for example. The antenna 1B thus makes it possible to achieve appropriate antenna characteristics while widening each frequency band, compared with the antenna having the first antenna electrode 11 and the second antenna electrode 12 on the same plane.

Other configurations and operations of the antenna 1B may be substantially similar to those of the antenna 1 according to the first embodiment.

Other Modification Examples of First Embodiment

As in the antenna 1B illustrated in FIG. 8 according to the second modification example, the probe layer 51 may be disposed between the first antenna layer 21 and the second antenna layer 22 in the antenna 1A illustrated in FIG. 7 according to the first modification example. In other words, the first antenna electrode 11, the probe electrode 31, and the second antenna electrode 12 may be disposed in this order from below.

2. SECOND EMBODIMENT (EXAMPLE CONFIGURATION OF ANTENNA HAVING THREE ANTENNA ELECTRODES

An antenna 2 according to a second embodiment of the disclosure will now be described. In the following description, components substantially the same as those of the antenna 1 according to the first embodiment are assigned with the same reference numerals without redundant description thereof.

2.1 Example Configuration of Antenna of Second Embodiment

Figure 9:
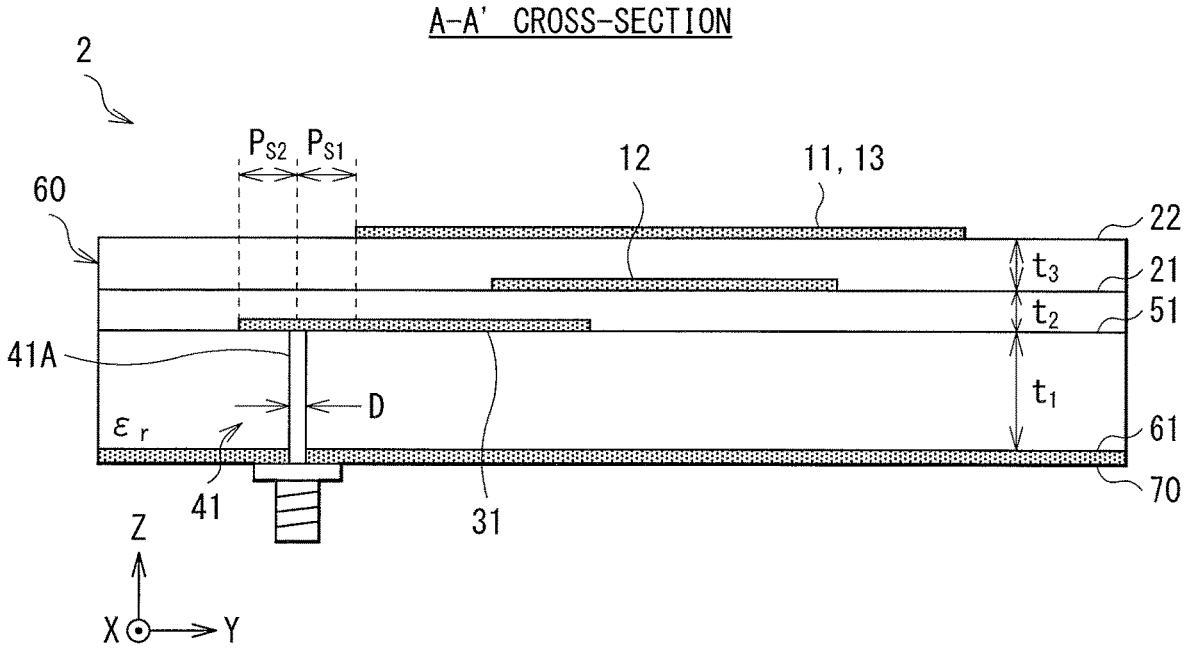
FIG. 9 is a cross-sectional view of an antenna according to one embodiment.
Figure 10A:
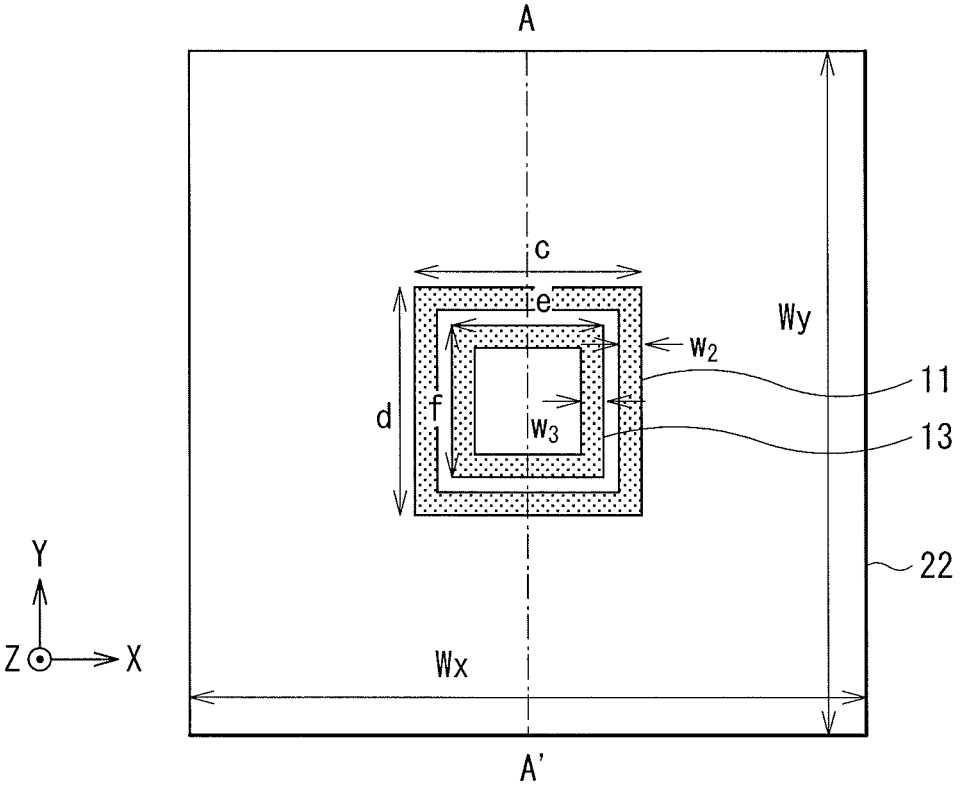
FIG. 10A is a plan view of an antenna layer of the antenna according to one embodiment.
Figure 10B:
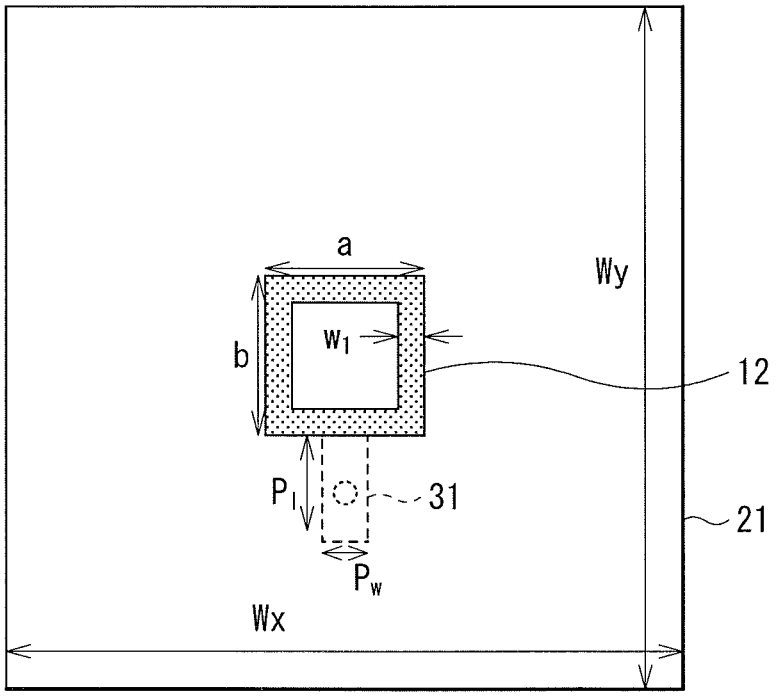
FIG. 10B is a plan view of another antenna layer of the antenna according to one embodiment.

FIG. 9 illustrates an example cross-sectional configuration of an antenna 2 according to the second embodiment of the disclosure. FIG. 10A illustrates an example planar configuration of a second antenna layer 22 of the antenna 2. FIG. 10B illustrates an example planar configuration of a first antenna layer 21 of the antenna 2. FIG. 9 is a cross-sectional view of the antenna 2 taken along the line A-A' of FIG. 10A.

The antenna 2 according to the second embodiment may further include a third antenna electrode 13 in addition to the components of the antenna 1 according to the first embodiment illustrated in FIG. 4 and FIGS. 5A and 5B. The third antenna electrode 13 may have an annular conductor pattern.

The second antenna layer 22 of the antenna 2 may correspond to a specific but non-limiting example of the first plane according to one embodiment of the disclosure. The first antenna layer 21 of the antenna 2 may correspond to a specific but non-limiting example of the second plane according to one embodiment of the disclosure. The probe layer 51 of the antenna 2 may correspond to a specific but non-limiting example of the third plane according to one embodiment of the disclosure. When the second plane is disposed below the first plane in the antenna 2, the first plane is the uppermost plane among the first to third planes.

The third antenna electrode 13 may be different in size from the first antenna electrode 11. The third antenna electrode 13 may have an annular shape and may be disposed together with the first antenna electrode 11 on the second antenna layer 22. The third antenna electrode 13 may be disposed inward from the inner periphery of the first antenna electrode 11 when seen in plan view along the stacking direction. Additionally, the outer periphery of the third antenna electrode 13 may overlap the second antenna electrode 12 when seen in plan view along the stacking direction. This configuration may couple the second antenna electrode 12 and the third antenna electrode 13 to each other in a resonating state.

The first antenna electrodes 11 to the third antenna electrodes 13 may be electrically powered via the power-feed connector 41 and the probe electrode 31.

The probe electrode 31 of the antenna 2 may overlap at least the first antenna electrode 11 and the second antenna electrode 12 when seen in plan view along the stacking direction. This configuration allows the first antenna electrode 11 to the third antenna electrode 13 to be electrically powered via the probe electrode 31. The probe electrode 31 of the antenna 2 may be disposed directly adjacent to the first antenna layer 21 in the stacking direction.

When the first antenna electrode 11 to the third antenna electrode 13 are electrically powered via the probe electrode 31 in the antenna 2, an electric current may flow in each of the antenna electrodes to cause each of the antenna electrodes to occur specific resonance based on the current path. The first antenna electrode 11 may serve as an antenna operating in a frequency band including a specific resonance frequency f1. The second antenna electrode 12 itself may resonate in a frequency band including a specific resonance frequency f2. The third antenna electrode 13 itself may resonate in a frequency band including a specific resonance frequency f3.

In the antenna 2, the second antenna electrode 12 and the third antenna electrode 13 that are adjacent to each other in the stacking direction may be coupled and paired to each other to serve, as a whole, as an antenna operating in a resonance frequency fb that is different from the specific resonance frequency f1 of the first antenna electrode 11.

In the antenna 2, the second antenna electrode 12 and the third antenna electrode 13 may each have a round-trip length shorter than that of the first antenna electrode 11, and the resonance frequency fb of the pair of the second antenna electrode 12 and the third antenna electrode 13 may be higher than the specific resonance frequency f1 of the first antenna electrode 11 (fb>f1). The antenna 2 as a whole may thus operate in two modes having different frequency bands.

Example dimensions and parameters of portions of the antenna 2 illustrated in FIG. 9 and FIGS. 10A and 10B are as follows:

$$Wx=8.0,\ Wy=8.0,\ a=b=1.25\pm0.15,\ c=d=2.4\pm0.2,\ e=f=1.25\pm0.15,\ w_1=0.26\pm0.06,\ w_2=0.3\pm0.05,\ w_3=0.2\pm0.05,\ P_{s1}=0.50,\ P_{s2}=0.52,\ P_1=1.62,\ P_w=0.40,\ D=0.20,\ t_1=0.80,\ t_2=0.20,\ t_3=0.30,\ \varepsilon r=3.4\pm0.5$$

where "εr" denotes a relative dielectric constant of the dielectric 60, and the reference characters other than "εr" denote respective dimensions in unit of millimeter [mm]. For example, all the outer periphery of the third antenna electrode 13 may overlap the second antenna electrode 12 when seen in plan view along the stacking direction.

In the antenna 2, the probe electrode 31 is remote from the first antenna electrode 11 and the third antenna electrode 13 by a first distance, and remote from the second antenna electrode 12 by a second distance along the stacking direction. The second distance is different from the first distance. In the antenna 2 illustrated in FIG. 9, the probe electrode 31 and the second antenna electrode 12 may be disposed in this order from below, and the first antenna electrode 11 and the third antenna electrode 13 may be disposed on the uppermost layer. The first distance may thus be longer than the second distance. In other words, the first antenna electrode 11 and the third antenna electrode 13 may be farther from the probe electrode 31 than the second antenna electrode 12 is. This makes it possible to widen the fractional bandwidth of a frequency band of the first antenna electrode 11 (i.e., a lower frequency band) and the fractional bandwidth of a frequency band of the third antenna electrode 13 (i.e., a higher frequency band). Additionally, the second antenna electrode 12 and the third antenna electrode 13 may be coupled to each other. This makes it possible to further widen the higher frequency band. The antenna 2 thus makes it possible to exhibit appropriate antenna characteristics while widening each frequency band, compared with the antenna having the first antenna electrode 11 and the second antenna electrode 12 on the same plane.

Other configurations and operations of the antenna 2 may be substantially similar to those of the antenna 1 according to the first embodiment.

2.2 Modification Example of Second Embodiment

First Modification Example

Figure 11:
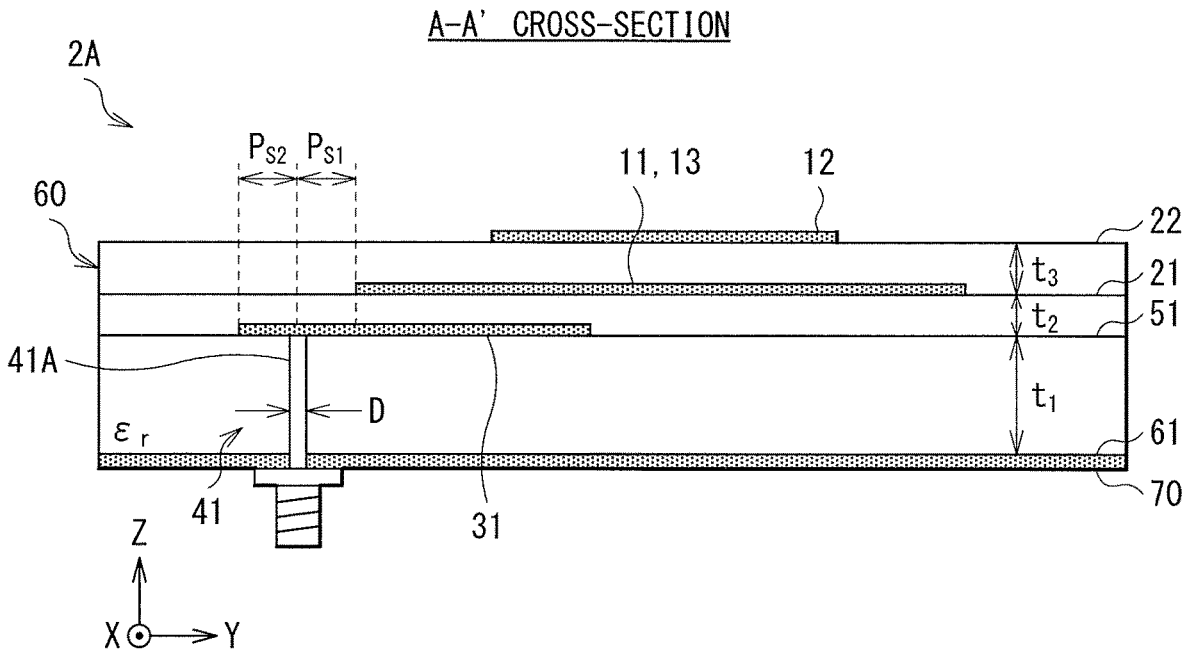
FIG. 11 is a cross-sectional view of an antenna according to one modification example of one embodiment.

FIG. 11 illustrates an example cross-sectional configuration of an antenna 2A according to a first modification example of the second embodiment of the disclosure. FIG.

12A illustrates an example planar configuration of a second antenna layer 22 of the antenna 2A. FIG. 12B illustrates an example planar configuration of a first antenna layer 21 of the antenna 2A. FIG. 11 is a cross-sectional view of the antenna 2A taken along the line A-A' of FIG. 12A.

The antenna 2A according to the first modification example may be different from the antenna 2 illustrated in FIG. 9 and FIGS. 10A and 10B in positions of the first antenna electrode 11, the third antenna electrode 13, and the second antenna electrode 12. Except for the difference in the positions, the first antenna electrode 11 of the antenna 2A may be similar in planar shape to the first antenna electrode 11 to the third antenna electrode 13 of the antenna 2 illustrated in FIG. 9 and FIGS. 10A and 10B.

The first antenna layer 21 of the antenna 2A may correspond to a specific but non-limiting example of the first plane according to one embodiment of the disclosure. The second antenna layer 22 of the antenna 2A may correspond to a specific but non-limiting example of the second plane according to one embodiment of the disclosure. The probe layer 51 of the antenna 2A may correspond to a specific but non-limiting example of the third plane according to one embodiment of the disclosure. When the first plane is disposed below the second plane in the antenna 2A, the second plane is the uppermost plane among the first to third planes.

The first antenna electrode 11 and the third antenna electrode 13 each having an annular shape may be disposed on the first antenna layer 21 of the antenna 2A. The first antenna electrode 11 may be different in size from the third antenna electrode 13.

The second antenna electrode 12 having an annular shape may be disposed on the second antenna layer 22 of the antenna 2A. The second antenna electrode 12 may be different in size from the first antenna electrode 11. The second antenna electrode 12 may be smaller in size than the first antenna electrode 11 and disposed inward from the outer periphery of the first antenna electrode 11 when seen in plan view along the stacking direction.

The third antenna electrode 13 of the antenna 2A may be disposed inward from the inner periphery of the first antenna electrode 11 when seen in plan view along the stacking direction. Additionally, the outer periphery of the third antenna electrode 13 of the antenna 2A may overlap the second antenna electrode 12 when seen in plan view along the stacking direction. This configuration may couple the second antenna electrode 12 and the third antenna electrode 13 to each other in a resonating state.

Figure 12A:
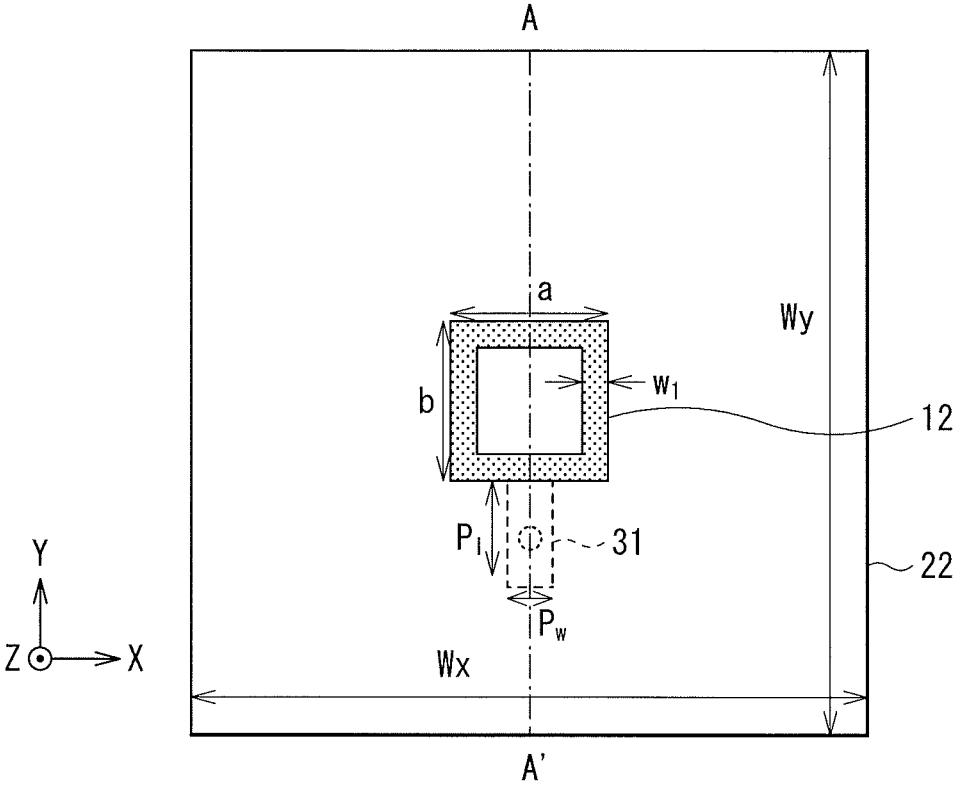
FIG. 12A is a plan view of an antenna layer of the antenna according to one modification example of one embodiment.
Figure 12B:
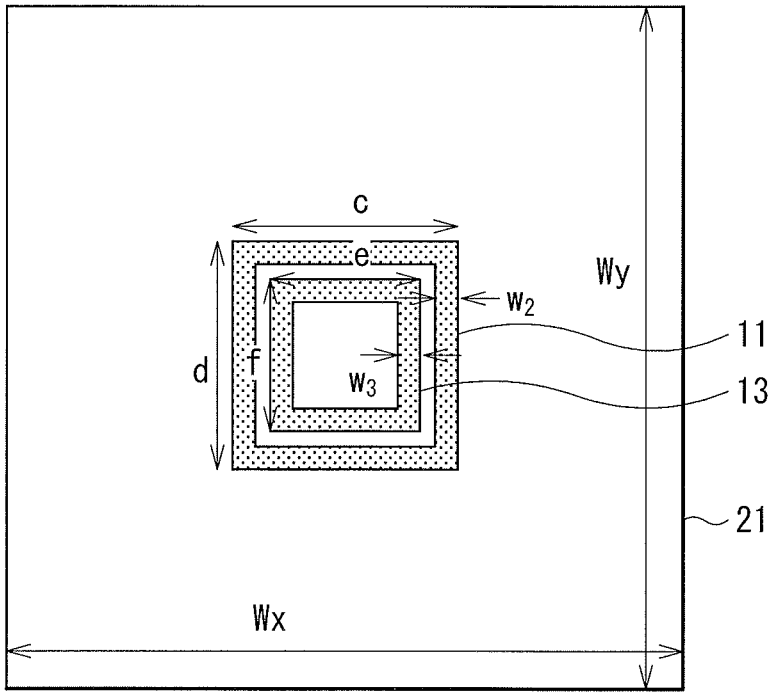
FIG. 12B is a plan view of another antenna layer of the antenna according to one modification example of one embodiment.

Example dimensions and other parameters of respective portions of the antenna 2A illustrated in FIG. 11 and FIGS. 12A and 12B are as follows:

$$Wx=8.0,\ Wy=8.0,\ a=b=1.25\pm0.15,\ c=d=2.4\pm0.2,$$
$$e=f=1.25\pm0.15,\ w_1=0.26\pm0.06,\ w_2=0.3\pm0.05,$$
$$w_3=0.2\pm0.05,\ P_{s1}=0.50,\ P_{s2}=0.52,\ P_1=1.62,$$
$$P_w=0.40,\ D=0.20,\ t_1=0.80,\ t_2=0.20,\ t_3=0.30,$$
$$\varepsilon r=3.4\pm0.5$$

where "εr" denotes a relative dielectric constant of the dielectric 60, and the reference characters other than "εr" denote respective dimensions in unit of millimeter [mm].

In the antenna 2A, the probe electrode 31 is remote from the first antenna electrode 11 and the third antenna electrode 13 by a first distance, and remote from the second antenna electrode 12 by a second distance along the stacking direction. The first direction is different from the second direction. In the antenna 2A, the second antenna electrode 12 may be disposed on the uppermost layer, and the first antenna electrode 11 and the third antenna electrode 13 may be disposed between the probe electrode 31 and the second antenna electrode 12. The first distance may thus be shorter than the second distance. In other words, the second antenna electrode 12 may be farther from the probe electrode 31 than the first antenna electrode 11 and the third antenna electrode 13 are. This makes it possible to widen the fractional bandwidths of a frequency band of the second antenna electrode 12 (i.e., a higher frequency band), for example. Additionally, the second antenna electrode 12 and the third antenna electrodes 13 may be coupled to each other. This makes it possible to further widen the higher frequency band. The antenna 2A thus makes it possible to exhibit appropriate antenna characteristics while widening each frequency band, compared with the antenna having the first antenna electrode 11 and the second antenna electrode 12 on the same plane.

Other configurations and operations of the antenna 2A may be substantially similar to those of the antenna 2 according to the second embodiment.

Second Modification Example

Figure 13:
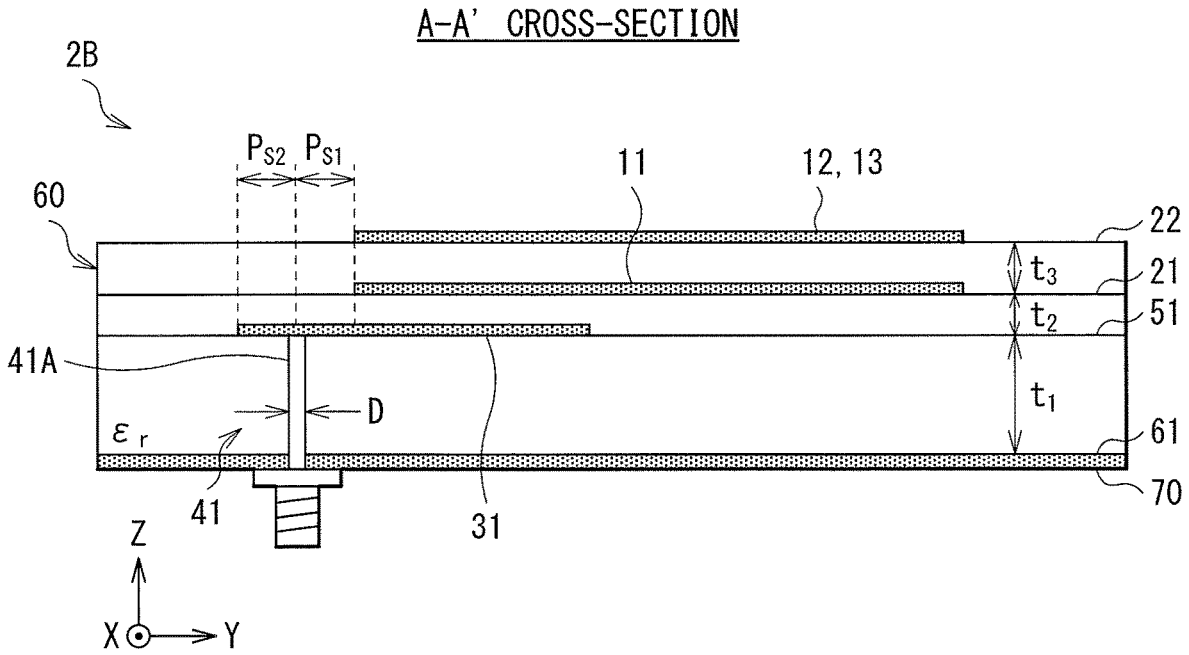
FIG. 13 is a cross-sectional view of an antenna according to one modification example of one embodiment.
Figure 14A:
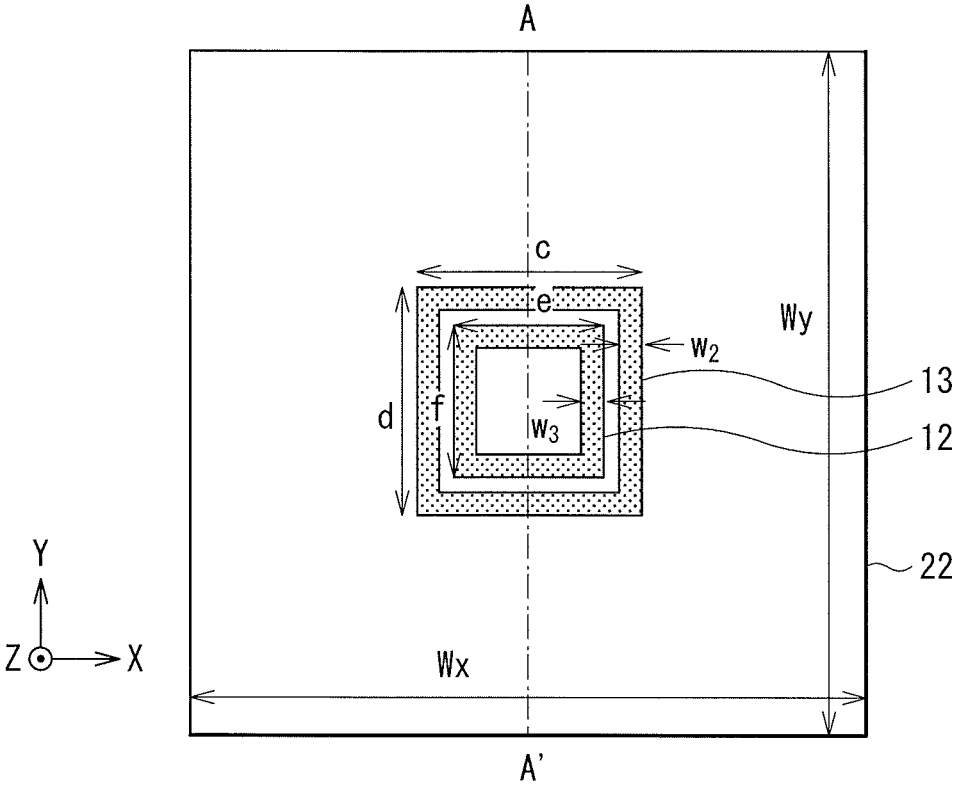
FIG. 14A is a plan view of an antenna layer of the antenna according to one modification example of one embodiment.
Figure 14B:
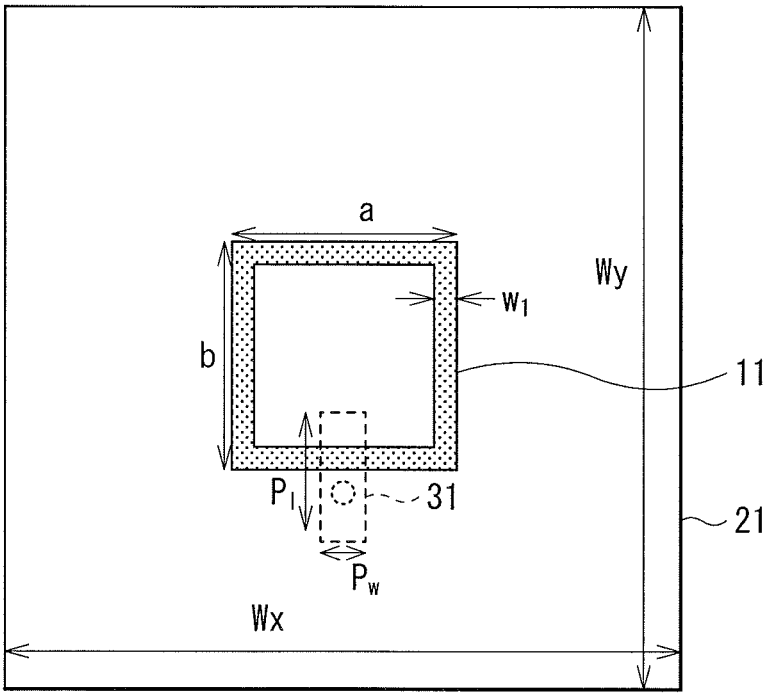
FIG. 14B is a plan view of another antenna layer of the antenna according to one modification example of one embodiment.

FIG. 13 illustrates an example cross-sectional configuration of an antenna 2B according to a second modification example of the second embodiment of the disclosure. FIG. 14A illustrates an example planar configuration of a second antenna layer 22 of the antenna 2B. FIG. 14B illustrates and example planar configuration of a first antenna layer 21 of the antenna 2B. FIG. 13 is a cross-sectional view of the antenna 2B taken along the line A-A' of FIG. 14A.

The antenna 2B according to the second modification example may be different from the antenna 2 illustrated in FIG. 9 and FIGS. 10A and 10B in positions of the first antenna electrode 11 and the second antenna electrode 12. Additionally, the first antenna electrode 11 of the antenna 2B may be larger than that of the antenna 2 illustrated in FIG. 9 and FIGS. 10A and 10B.

The first antenna layer 21 of the antenna 2B may correspond to a specific but non-limiting example of the first plane according to one embodiment of the disclosure. The second antenna layer 22 of the antenna 2B may correspond to a specific but non-limiting example of the second plane according to one embodiment of the disclosure. The probe layer 51 of the antenna 2B may correspond to a specific but non-limiting example of the third plane according to one embodiment of the disclosure. When the first plane is disposed below the second plane in the antenna 2B, the second plane is the uppermost plane among the first to third planes.

The first antenna electrode 11 having an annular shape is disposed on the first antenna layer 21 of the antenna 2B.

The second antenna electrode 12 and the third antenna electrode 13 each having an annular shape may be disposed on the second antenna layer 22 of the antenna 2B. The second antenna electrode 12 may be different in size from the third antenna electrode 13. The second antenna electrode 12 may be smaller in size than the first antenna electrode 11 and disposed inward from the outer periphery of the first antenna electrode 11 when seen in plan view along the stacking direction. Additionally, the second antenna electrode 12 of the antenna 2B, which is different in size from the third antenna electrode 13 and disposed together with the third antenna electrode 13 on the second antenna layer 22, may be disposed inward from the inner periphery of the third antenna electrode 13 when seen in plan view along the stacking direction. The outer periphery of the third antenna electrode 13 of the antenna 2B, which is disposed on the second antenna layer 22, may overlap the first antenna electrode 11 when seen in plan view along the stacking direction. This configuration may couple the first antenna electrode 11 and the third antenna electrode 13 to each other in a resonating state.

In the antenna 2B, the first antenna electrode 11 and the third antenna electrode 13 that are adjacent to each other in the stacking direction may be coupled and paired to each other to serve, as a whole, as an antenna operating in a resonance frequency fa that is different from the specific resonance frequency f2 of the second antenna electrode 12.

In the antenna 2B, the first antenna electrode 11 and the third antenna electrode 13 may each have a round-trip length longer than that of the second antenna electrode 12, and the resonance frequency fa of the pair of the first antenna electrode 11 and the third antenna electrode 13 may be lower than the specific resonance frequency f2 of the second antenna electrode 12 (f2>fa). The antenna 2B as a whole may thus operate in two modes having different frequency bands.

Example dimensions and parameters of portion of the antenna 2B illustrated in FIG. 13 and FIGS. 14A and 14B are as follows:

$$Wx=8.0,\ Wy=8.0,\ a=b=2.4\pm0.2,\ c=d=2.4\pm0.2,\ e=f=1.25\pm0.15,\ w_1=0.26\pm0.06,\ w_2=0.3\pm0.05,\ w_3=0.2\pm0.05,\ P_{s1}=0.50,\ P_{s2}=0.52,\ P_1=1.62,\ P_w=0.40,\ D=0.20,\ t_1=0.80,\ t_2=0.20,\ t_3=0.30,\ \varepsilon r=3.4\pm0.5$$

where "εr" denotes a relative dielectric constant of the dielectric 60, and the reference characters other than "εr" denote respective dimensions in unit of millimeter [mm]. For example, all the outer periphery of the third antenna electrode 13 may overlap the first antenna electrode 11 when seen in plan view along the stacking direction.

In the antenna 2B, the probe electrode 31 is remote from the first antenna electrode 11 by a first distance, and remote from the second antenna electrode 12 and the third antenna electrode 13 by a second distance along the stacking direction. The second distance is different from the first distance. In the antenna 2B illustrated in FIG. 13, the probe electrode 31 and the first antenna electrode 11 may be disposed in this order from below, and the second antenna electrode 12 and the third antenna electrode 13 may be disposed on the uppermost layer. The first distance may thus be shorter than the second distance. In other words, the second antenna electrode 12 and the third antenna electrode 13 may be farther from the probe electrode 31 than the first antenna electrode 11 is. This makes it possible to widen the fractional bandwidth of a frequency band of the third antenna electrode 13 (i.e., a lower frequency band) and the fractional bandwidth of a frequency band of the second antenna electrode 12 (i.e., a higher frequency band). Additionally, the first antenna electrode 11 and the third antenna electrode 13 may be coupled to each other. This makes it possible to further widen the lower frequency band. The antenna 2B thus makes it possible to exhibit appropriate antenna characteristics while widening each frequency band, compared with the antenna having the first antenna electrode 11 and the second antenna electrode 12 on the same plane.

Other configurations and operations of the antenna 2B may be substantially similar to those of the antenna 2 according to the second embodiment.

Third Modification Example

Figure 15:
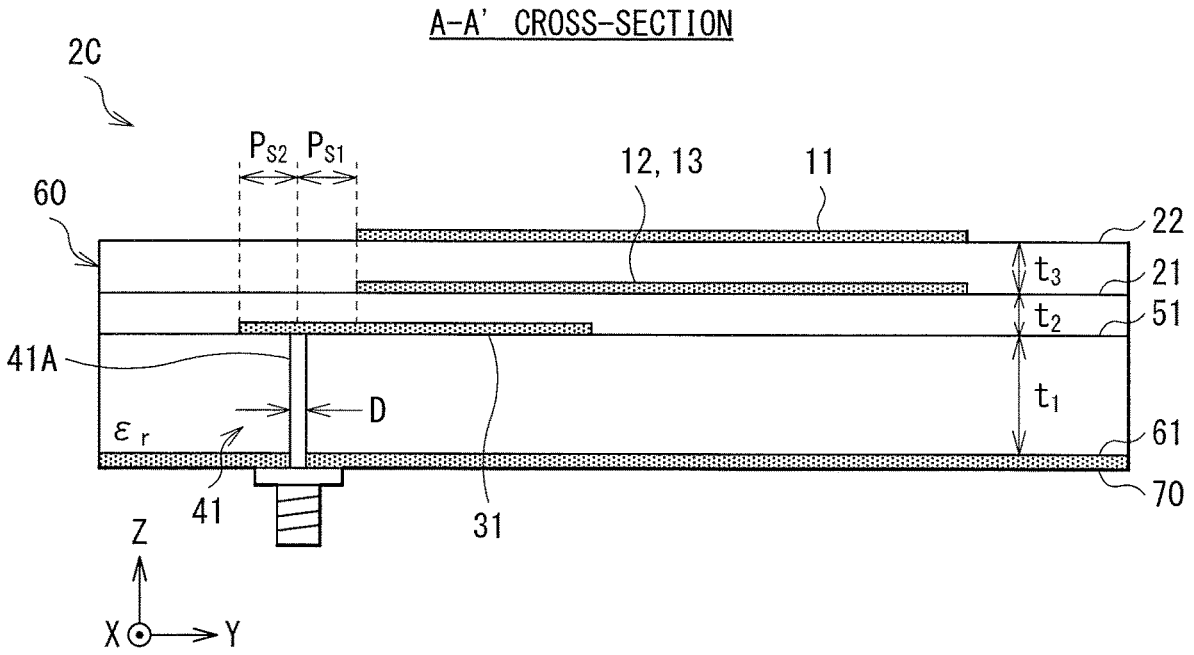
FIG. 15 is a cross-sectional view of an antenna according to one modification example of one embodiment.
Figure 16A:
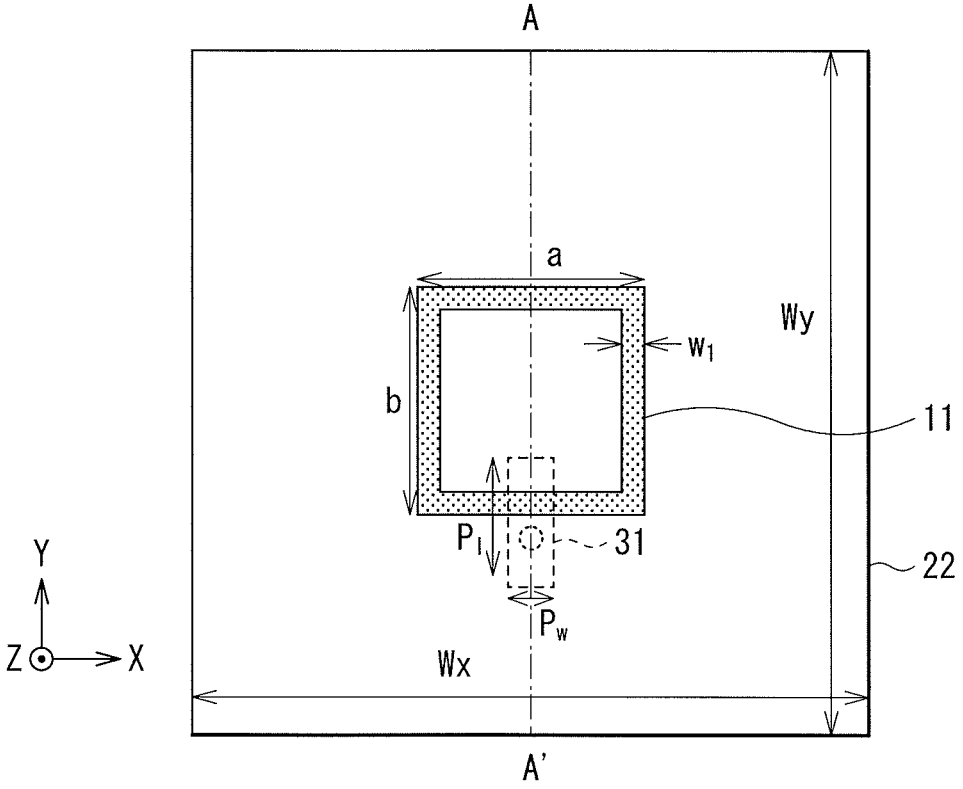
FIG. 16A is a plan view an antenna layer of the antenna according to one modification example of one embodiment.
Figure 16B:
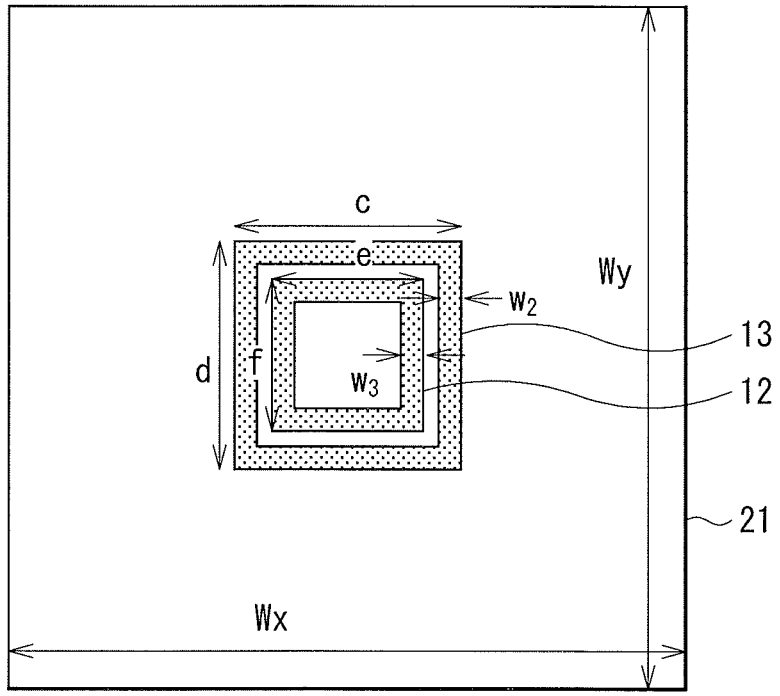
FIG. 16B is a plan view another antenna layer of the antenna according to one modification example of one embodiment.

FIG. 15 illustrates an example cross-sectional configuration of an antenna 2C according to a third modification example of the second embodiment of the disclosure. FIG. 16A illustrates an example planer configuration of a second antenna layer 22 of the antenna 2C. FIG. 16B illustrates an example planar configuration of a first antenna layer 21 of the antenna 2C. FIG. 15 is a cross-sectional view of the antenna 2C taken along the line A-A' of FIG. 16A.

The antenna 2C according to the third modification example may be different from the antenna 2 illustrated in FIG. 9 and FIGS. 10A and 10B in position of the first antenna electrode 11. Additionally, the first antenna electrode 11 of the antenna 2C may be larger than that of the antenna 2 illustrated in FIG. 9 and FIGS. 10A and 10B.

The second antenna layer 22 of the antenna 2C may correspond to a specific but non-limiting example of the first plane according to one embodiment of the disclosure. The first antenna layer 21 of the antenna 2C may correspond to a specific but non-limiting example of the second plane according to one embodiment of the disclosure. The probe layer 51 of the antenna 2C may correspond to a specific but non-limiting example of the third plane according to one embodiment of the disclosure. When the second plane is disposed below the first plane in the antenna 2C, the first plane is the uppermost plane among the first to third planes.

The first antenna electrode 11 having an annular shape may be disposed on the second antenna layer 22 of the antenna 2C.

The second antenna electrode 12 and the third antenna electrode 13 each having an annular shape may be disposed on the first antenna layer 21 of the antenna 2C. The second antenna electrode 12 may be different in size from the third antenna electrode 13. The second antenna electrode 12 may be smaller in size than the first antenna electrode 11 and disposed inward from the outer periphery of the first antenna electrode 11 when seen in plan view along the stacking direction. Additionally, the second antenna electrode 12 of the antenna 2C, which is different in size from the third antenna electrode 13 and disposed together with the third antenna electrode 13 on the first antenna layer 21, may be disposed inward from the inner periphery of the third antenna electrode 13 when seen in plan view along the stacking direction. The outer periphery of the third antenna electrode 13 of the antenna 2C, which is disposed on the first antenna layer 21, may overlap the first antenna electrode 11 when seen in plan view along the stacking direction. This configuration may couple the first antenna electrode 11 and the third antenna electrode 13 to each other in a resonating state.

In the antenna 2C, the first antenna electrode 11 and the third antenna electrode 13 that are adjacent to each other in the stacking direction may be coupled and paired to each other. The pair of the first antenna electrode 11 and the third antenna electrode 13 as a whole may operate in a resonance frequency fa that is different from the specific resonance frequency f2 of the second antenna electrode 12.

In the antenna 2C, the first antenna electrode 11 and the third antenna electrode 13 may each have a round-trip length longer than that of the second antenna electrode 12, and the resonance frequency fa of the pair of the first antenna electrode 11 and the third antenna electrode 13 may be lower than the specific resonance frequency f2 of the second antenna electrode 12 (f2>fa). The antenna 2C as a whole may thus operate in two modes having different frequency bands.

Example dimensions and parameters of portion of the antenna 2C illustrated in FIG. 15 and FIGS. 16A and 16B are as follows:

$Wx$=8.0, $Wy$=8.0, $a$=$b$=2.4±0.2, $c$=$d$=2.4±0.2, $e$=$f$=1.25±0.15, $w1$=0.26±0.06, $w2$=0.3±0.05, $w3$=0.2±0.05, $Ps1$=0.50, $Ps2$=0.52, $P1$=1.62, $Pw$=0.40, $D$=0.20, $t1$=0.80, $t2$=0.20, $t3$=0.30, $\varepsilon r$=3.4±0.5 where "εr" denotes a relative dielectric constant of the dielectric 60, and the reference characters other than "εr" denote respective dimensions in unit of millimeter [mm]. For example, all the outer periphery of the third antenna electrode 13 may overlap the first antenna electrode 11 when seen in plan view along the stacking direction.

In the antenna 2C, the probe electrode 31 is remote from the first antenna electrode 11 by a first distance, and remote from the second antenna electrode 12 and the third antenna electrode 13 by a second distance along the stacking direction. The second distance is different from the first distance. In the antenna 2C, the first antenna electrode 11 may be disposed on the uppermost layer, and second antenna electrode 12 and the third antenna electrode 13 may be disposed between the probe electrode 31 and the first antenna electrode 11. The first distance may thus be longer than the second distance. In other words, the first antenna electrode 11 may be farther from the probe electrode 31 than the second antenna electrode 12 and the third antenna electrode 13 are. This makes it possible to widen the fractional bandwidth of a frequency band of the first antenna electrode 11 (i.e., a lower frequency band). Additionally, the first antenna electrode 11 and the third antenna electrode 13 may be coupled to each other. This makes it possible to further widen the lower frequency band. The antenna 2C thus makes it possible to exhibit appropriate antenna characteristics while widening each frequency band, compared with the antenna having the first antenna electrode 11 and the second antenna electrode 12 on the same plane.

Other configurations and operations of the antenna 2C may be substantially similar to those of the antenna 2 according to the second embodiment.

Other Modification Examples of Second Embodiment

As in the antenna 1B illustrated in FIG. 8 according to the second modification example of the first embodiment, the probe layer 51 may be disposed between the first antenna layer 21 and the second antenna layer 22 in the antenna 2 according to the second embodiment and the antennas 2A, 2B, and 2C according to the other modification examples of the second embodiment. Also in this case, two configurations may be envisaged: the first distance may be longer than the second distance in one configuration, while the first distance may be shorter than the second distance in the other configuration. In other words, two configurations may be envisaged: the first antenna electrode 11 may be farther from the probe electrode 31 than the second antenna electrode 12 is in one configuration, while the second antenna electrode 12 may be farther from the probe electrode 31 than the first antenna electrode 11 is in the other configuration. The configuration in which the first distance is longer than the second distance makes it possible to widen the fractional bandwidth of a frequency band of the first antenna electrode 11 (i.e., a lower frequency band), for example. The configuration in which the second distance is longer than the first distance makes it possible to widen the fractional bandwidth of a frequency band of the second antenna electrode 12 (i.e., a higher frequency band), for example. The antenna according to the modification example thus makes it possible to exhibit appropriate antenna characteristics while widening each frequency band, compared with the antenna having the first antenna electrode 11 and the second antenna electrode 12 on the same plane.

3. OTHER EMBODIMENTS

It should be understood by those skilled in the art that various modifications, combinations, sub-combinations and alterations may occur depending on design requirements and other factors insofar as they are within the scope of the appended claims or the equivalents thereof.

For example, the antenna according to any of the foregoing embodiments may be disposed together with other circuitry on a single substrate to form a module.

The foregoing embodiments and modification examples may be applied in any combination. It should be appreciated that the effects described herein are mere examples. Effects of an embodiment of the disclosure are not limited to those described herein. The disclosure may further include any effect other than those described herein.

It is possible to achieve at least the following configurations from the above-described example embodiments and modification examples of the disclosure.

(1) An antenna including:

a dielectric having a first plane, a second plane, and a third plane that are different from each other and stacked parallel to each other in a stacking direction;

a first antenna electrode having an annular shape and disposed on the first plane;

a second antenna electrode having an annular shape and disposed on the second plane, the second antenna electrode being different in size from the first antenna electrode and disposed inward from an outer periphery of the first antenna electrode when seen in plan view along the stacking direction; and a probe electrode disposed on the third plane and overlapping the first antenna electrode and the second antenna electrode when seen in the plan view along the stacking direction, the first antenna electrode and the second antenna electrode being configured to be electrically powered via the probe electrode, the probe electrode being remote from the first antenna electrode by a first distance and remote from the second antenna electrode by a second distance along the stacking direction, the second distance being different from the first distance.

(2) The antenna according to (1), in which the first distance is longer than the second distance.

(3) The antenna according to (1) or (2), in which the first plane is an uppermost plane among the first plane, the second plane, and the third plane when the second plane is disposed below the first plane in the stacking direction.

(4) The antenna according to any one of (1) to (3), in which the third plane is disposed between the first plane and the second plane in the stacking direction.

(5) The antenna according to (1), in which the first distance is shorter than the second distance.

(6) The antenna according to (1) or (5), in which the second plane is an uppermost plane among the first plane, the second plane, and the third plane when the first plane is disposed below the second plane in the stacking direction.

(7) The antenna according to (5) or (6), in which the third plane is disposed between the first plane and the second plane in the stacking direction.

(8) The antenna according to any one of (1) to (7), further including a third antenna electrode having an annular shape and disposed on the first plane or the second plane.

(9) The antenna according to (8), in which the third antenna electrode is disposed together with the first antenna electrode on the first plane, the third antenna electrode being different in size from the first antenna electrode, disposed inward from an inner periphery of the first antenna electrode when seen in the plan view along the stacking direction, and having an outer periphery overlapping the second antenna electrode when seen in the plan view along the stacking direction.

(10) The antenna according to (8), in which the second antenna electrode is disposed together with the third antenna electrode on the second plane, the second antenna electrode being different in size from the third antenna electrode, the second antenna electrode being disposed inward from an inner periphery of the third antenna electrode when seen in the plan view along the stacking direction, the third antenna electrode having an outer periphery overlapping the first antenna electrode when seen in the plan view along the stacking direction.

An antenna according to one embodiment of the disclosure, the probe electrode and the multiple annular antenna electrodes are disposed in an appropriate arrangement in a stacked fashion. Accordingly, the antenna makes it possible to achieve appropriate antenna characteristics that make a fractional bandwidth broader in each frequency band.

Although the disclosure has been described in terms of example embodiments, it is not limited thereto. It should be appreciated that variations may be made in the described embodiments by persons skilled in the art without departing from the scope of the disclosure as defined by the following claims. The limitations in the claims are to be interpreted broadly based on the language employed in the claims and not limited to examples described in this specification or during the prosecution of the application, and the examples are to be construed as non-exclusive. For example, in this disclosure, the use of the terms first, second, etc. do not denote any order or importance, but rather the terms first, second, etc. are used to distinguish one element from another. Moreover, no element or component in this disclosure is intended to be dedicated to the public regardless of whether the element or component is explicitly recited in the following claims.

What is claimed is:

1. An antenna comprising:

a dielectric having a first plane, a second plane, and a third plane that are different from each other and stacked parallel to each other in a stacking direction;

a first antenna electrode having an annular shape and disposed on the first plane;

a second antenna electrode having an annular shape and disposed on the second plane, the second antenna electrode being different in size from the first antenna electrode and disposed inward from an outer periphery of the first antenna electrode when seen in plan view along the stacking direction; and a probe electrode disposed on the third plane and overlapping the first antenna electrode and the second antenna electrode when seen in the plan view along the stacking direction, the first antenna electrode and the second antenna electrode being configured to be electrically powered via the probe electrode, the probe electrode being remote from the first antenna electrode by a first distance and remote from the second antenna electrode by a second distance along the stacking direction, the second distance being different from the first distance.

2. The antenna according to claim 1, wherein the first distance is longer than the second distance.

3. The antenna according to claim 1, wherein the first plane comprises an uppermost plane among the first plane, the second plane, and the third plane when the second plane is disposed below the first plane in the stacking direction.

4. The antenna according to claim 1, wherein the third plane is disposed between the first plane and the second plane in the stacking direction.

5. The antenna according to claim 1, wherein the first distance is shorter than the second distance.

6. The antenna according to claim 1, wherein the second plane comprises an uppermost plane among the first plane, the second plane, and the third plane when the first plane is disposed below the second plane in the stacking direction.

7. The antenna according to claim 5, wherein the third plane is disposed between the first plane and the second plane in the stacking direction.

8. The antenna according to claim 1, further comprising a third antenna electrode having an annular shape and disposed on the first plane or the second plane.

9. The antenna according to claim 8, wherein the third antenna electrode is disposed together with the first antenna electrode on the first plane, the third antenna electrode being different in size from the first antenna electrode, disposed inward from an inner periphery of the first antenna electrode when seen in the plan view along the stacking direction, and having an outer periphery overlapping the second antenna electrode when seen in the plan view along the stacking direction.

10. The antenna according to claim 8, wherein the second antenna electrode is disposed together with the third antenna electrode on the second plane, the second antenna electrode being different in size from the third antenna electrode, the second antenna electrode being disposed inward from an inner periphery of the third antenna electrode when seen in the plan view along the stacking direction, the third antenna electrode having an outer periphery overlapping the first antenna electrode when seen in the plan view along the stacking direction.

* * * * *